US006234477B1

(12) United States Patent
Scrymgeour et al.

(10) Patent No.: US 6,234,477 B1
(45) Date of Patent: May 22, 2001

(54) INTEGRATED LOTTERY POUCH

(75) Inventors: Lyle Harold Scrymgeour, Dugald; Michael John Brickwood, Winnipeg, both of (CA)

(73) Assignee: Pollard Banknote Limited, Winnipeg (CA)

( * ) Notice: Subject to any disclaimer, the term of this patent is extended or adjusted under 35 U.S.C. 154(b) by 0 days.

(21) Appl. No.: 09/406,688

(22) Filed: Sep. 27, 1999

(51) Int. Cl.[7] ..... A63B 71/00

(52) U.S. Cl. ..... 273/139; 273/138; 283/94; 283/903; 283/100; 283/85

(58) Field of Search ..... 273/139, 138, 273/292; 283/94, 85, 903, 100; 463/16, 17, 25

(56) References Cited

U.S. PATENT DOCUMENTS

| | | | | |
|---|---|---|---|---|
| 4,174,857 | * | 11/1979 | Koza | 283/6 |
| 4,299,637 | * | 11/1981 | Oberdeck et al. | 156/64 |
| 4,398,708 | | 8/1983 | Goldman et al. . | |
| 4,513,993 | * | 4/1985 | Brown | 283/103 |
| 5,021,110 | * | 6/1991 | Kobayashi | 156/249 |
| 5,125,689 | | 6/1992 | Heninger . | |
| 5,217,258 | * | 6/1993 | Sanderson | 283/105 |
| 5,253,899 | * | 10/1993 | Greenwood | 283/106 |
| 5,255,456 | * | 10/1993 | Franklin | 40/124.1 |
| 5,311,017 | * | 5/1994 | Filo | 250/316.1 |
| 5,414,262 | * | 5/1995 | Filo | 250/316.1 |
| 5,542,710 | | 8/1996 | Silverschotz et al. . | |
| 5,562,284 | * | 10/1996 | Stevens | 273/139 |
| 5,618,112 | * | 4/1997 | Lovell | 283/103 |
| 5,716,688 | * | 2/1998 | Burke et al. | 428/43 |
| 5,749,784 | * | 5/1998 | Clapper, Jr. | 463/17 |
| 5,785,315 | * | 7/1998 | Eiteneer et al. | 273/139 |
| 5,921,547 | * | 7/1999 | Wilner | 273/139 |
| 5,928,082 | * | 7/1999 | Clapper, Jr. | 463/16 |
| 5,949,042 | * | 9/1999 | Dietz, II et al. | 235/375 |
| 5,988,688 | * | 11/1999 | Such | 283/100 |
| 6,056,289 | * | 5/2000 | Clapper, Jr. | 273/138.2 |
| 6,145,885 | * | 11/2000 | Scrymgeour et al. | 283/94 |

FOREIGN PATENT DOCUMENTS

WO 98/57715 12/1998 (WO) .

* cited by examiner

*Primary Examiner*—Steven Wong
*Assistant Examiner*—D Collins
(74) *Attorney, Agent, or Firm*—Adrian D. Battison

(57) ABSTRACT

Described herein is a lottery ticket composed of two ticket portions, each having a rear surface and a front surface. The front surfaces include promotional graphics and lottery information whereas the rear surfaces include lottery indicia, some of which are covered with a scratch-off layer. The lottery ticket is formed by connecting the rear surfaces together such that the lottery indicia are facing one another and are not visible without separating the lottery ticket into its two portions. The ticket assembly thus forms in effect a pouch enveloping the lottery indicia but without the wastefulness of a separate pouch material.

21 Claims, 9 Drawing Sheets

INTEGRATED LOTTERY POUCH

The present invention relates generally to the field of lottery tickets and more particularly to a combined ticket assembly which simulates the provision of a pouch for containing the game tickets.

BACKGROUND OF THE INVENTION

Lottery tickets are well known and widely sold and typically comprise a sheet material of paper or card stock on which is printed lottery information and various indicia for the playing of one or more games. Many such games are instant win type games where the player can play the game or games by carrying out various functions, such as removing a scratch-off layer or opening pull tabs. Such lottery tickets generally include information such as ticket numbers or bar codes which identify the ticket and may also include a "void if removed" section for the purposes of security and control.

One practice that has become prevalent in Canada is to sell such lottery tickets in a pouch that is formed from two layers which are sealed around the edge of the pouch so that the lottery ticket is sandwiched between the two layers. This technique provides a number of advantages, including: increased security, as the lottery ticket is sealed within a closed pouch and more attractive appearance through the use of metalized materials, which in turn causes higher customer-perceived value. In addition, multiple sheets and/or tickets can be included in the pouch.

Unfortunately, this packaging adds to the cost of manufacturing the lottery tickets and also causes a perception problem in these enviro-friendly times in that the packaging is strictly ornamental and is intended to be discarded.

As shown in published PCT International application No. WO 98/57715 published Dec. 23rd 1998 of the present applicants there is provided a pouched lottery ticket which is supplied in a fan folded continuous strip arrangement for separating each pouch containing a ticket from the next at a dispensing station. The disclosure of this publication is hereby incorporated herein by reference.

U.S. Pat. No. 4,174,857 (Koza) and U.S. Pat. No. 5,253,899 (Greenwood) each disclose a combined ticket construction in which a second layer is applied or folded over the basic ticket to improve security. U.S. Pat. No. 5,562,284 discloses a break-open ticket with a second level of break-open.

SUMMARY OF THE INVENTION

It is one object of the present invention to provide a lottery ticket arrangement which provides the advantages of the pouch while reducing the extra cost and potential waste.

According to a first aspect of the invention, there is provided a lottery ticket comprising:

a first ticket portion formed by substantially flat substrate sheet material having a front surface and a rear surface, said front surface having promotional graphics printed thereon, said rear surface having lottery indicia printed thereon, at least some of the lottery indicia being covered with a scratch-off layer; and a second ticket portion formed by substantially flat substrate sheet material having a front surface and a rear surface, said rear surface having lottery indicia printed thereon, at least some of the lottery indicia being covered with a scratch-off layer, the rear surface of the first ticket portion connected to the rear surface of the second ticket portion to form the lottery ticket assembly, wherein the lottery ticket assembly is arranged to separate into at least two portions for exposing the lottery indicia on the rear surface of the first ticket portion and the lottery indicia on the rear surface of the second ticket portion.

The front surface of the first ticket portion may include a line of weakness for separating the lottery ticket into at least two portions.

The lottery indicia may be variable imaged.

The first ticket portion and the second ticket portion may have side edges and the first ticket portion and the second ticket portion may be connected along said side edges.

The first ticket portion and the second ticket portion may be connected by an adhesive.

The line of weakness may be located within the side edges of the first ticket portion such that the adhesive does not interfere with separation of the lottery ticket into at least two portions.

The lottery ticket may be characterized by an absence of lottery indicia on the outer surface of the first ticket portion.

The lottery ticket may be characterized by an absence of lottery indicia on the outer surface of the second ticket portion.

The lottery indicia on the first ticket portion may include a first bar code and the lottery indicia on the second ticket portion may include a second bar code, said first bar code differing from said second bar code for redeeming the first ticket portion and the second ticket portion independently of one another.

The lottery ticket may include tear means for initiating separation of the lottery ticket construction, said tear means being at a position on the rear surface portion of the first ticket portion within the line of weakness.

According to a second aspect of the invention, there is provided a lottery ticket construction comprising a plurality of lottery tickets, each one of said lottery tickets having:

a first ticket portion formed by substantially flat substrate sheet material having a front surface and a rear surface, said front surface having promotional graphics printed thereon, said rear surface having lottery indicia printed thereon, at least some of the lottery indicia being covered with a scratch-off layer; and a second ticket portion formed by substantially flat substrate sheet material having a front surface and a rear surface, said rear surface having lottery indicia printed thereon, at least some of the lottery indicia being covered with a scratch-off layer, the rear surface of the first ticket portion connected to the rear surface of the second ticket portion to form the lottery ticket having a front edge and a rear edge, wherein the lottery ticket construction is arranged to separate into at least two portions for exposing the lottery indicia on the rear surface of the first ticket portion and the lottery indicia on the rear surface of the second ticket portion, wherein the front edge of a first representative one of the lottery tickets is connected to the rear edge of a second representative one of the lottery tickets at a junction.

The junctions may include perforations for separating a first lottery ticket from a second lottery ticket.

The lottery tickets may be folded along each junction with the fold at the front edge of each lottery ticket being in a direction opposite to the fold at the rear edge of each lottery ticket so that the lottery tickets lie each on top of and parallel to the next.

According to a third aspect of the invention, there is provided a method of preparing a lottery ticket comprising:

providing a first ticket portion formed by substantially flat substrate sheet material having a front surface and a rear surface, said front surface having promotional graphics printed thereon and said rear surface having lottery indicia printed thereon, said lottery indicia being covered with a scratch-off layer;

providing a second ticket portion formed by substantially flat substrate sheet material having a front surface and a rear surface, said rear surface having lottery indicia printed thereon, said lottery indicia being covered with a scratch-off layer; and connecting the rear surface of the first ticket portion to the rear surface of the second ticket portion, thereby forming a lottery ticket, said lottery ticket arranged to be separated into at least two portions for exposing the lottery indicia.

The front surface of the first ticket portion may include a line of weakness for separating the lottery ticket construction into at least two portions and viewing the lottery indicia.

The lottery indicia may be variable imaged.

The first ticket portion and the second ticket portion may have side edges and the first ticket portion and the second ticket portion may be connected along said side edges.

The method may include connecting the first ticket portion and the second ticket portion with an adhesive.

Preferably, the line of weakness is located with the side edges of the first ticket portion.

There may be provided a first bar code on the lottery indicia on the first ticket portion and a second bar code on the lottery indicia on the second ticket portion, said first bar code differing from said second bar code so that the first ticket portion and the second ticket portion can be redeemed independently.

BRIEF DESCRIPTION OF THE DRAWINGS

One embodiment of the invention will now be described in conjunction with the accompanying drawings in which.

In the drawings like characters of reference indicate corresponding parts in the different figures.

DESCRIPTION OF THE PREFERRED EMBODIMENTS

Referring to FIGS. 1 to 5, a lottery ticket assembly 1 comprises a first ticket portion 10 and a second ticket portion 12.

Figure 1:
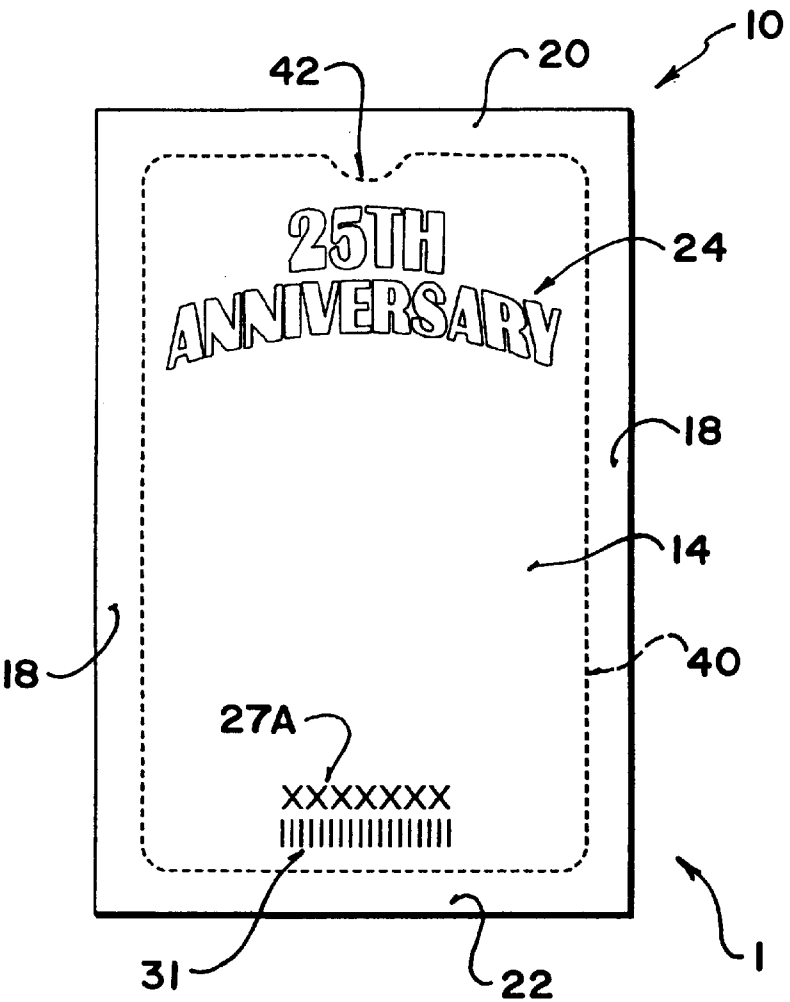
FIG. 1 is a front view of the lottery ticket assembly.
Figure 3:
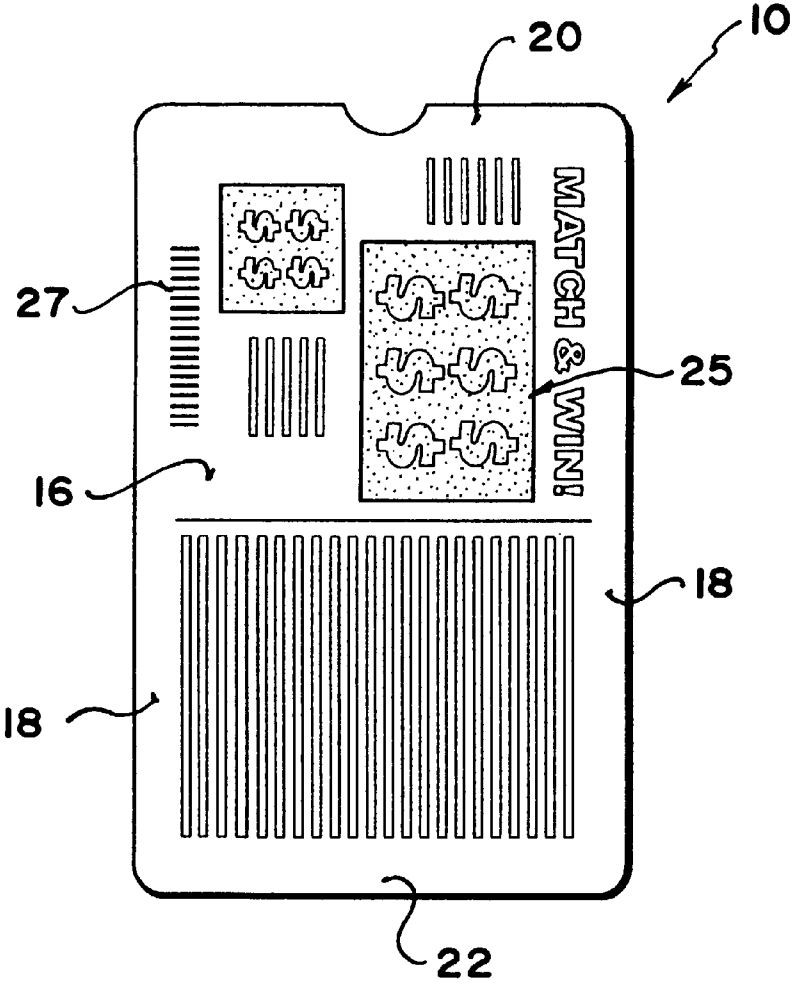
FIG. 3 is a rear view of the first ticket portion after it is torn from the assembly.

The first ticket portion 10 is formed by substantially flat substrate sheet material and has a front surface 14, a rear surface 16, side edges 18, a top edge 20 and a bottom edge 22, as shown in FIG. 1. The front surface 14 has promotional graphics 24 printed thereon, as shown in FIG. 1. In the embodiment shown, the rear surface 16 has lottery indicia 25 printed thereon and at least some of the lottery indicia are covered with a scratch-off layer, as shown in FIG. 3. That is, at least some of the lottery indicia are obscured with a scratch-off layer which is removed by the purchaser when "playing", as described below. In the embodiment shown, the front surface 14 does not have any lottery indicia printed thereon. Furthermore, in some embodiments, the front surface 14 includes a bar code 31 for identification of the lottery ticket 1. The lottery indicia 25 may include a bar code 27 for identification and redemption and a void if removed section for security. In some embodiments, the bar code 27 may be identical to the bar code 31. The barcodes shown schematically all include a machine readable portion and preferably also a human readable portion. A human readable portion of the bar code is indicated at 27A. Because the bar code is printed by variable image printing techniques, it is unique to the specific ticket and is not merely a number identifying particular winning indicia.

In an alternative arrangement (not shown), the front surface 14 also carries an instant win game in the form of lottery ticket indicia covered by a scratch-off material.

Figure 2:
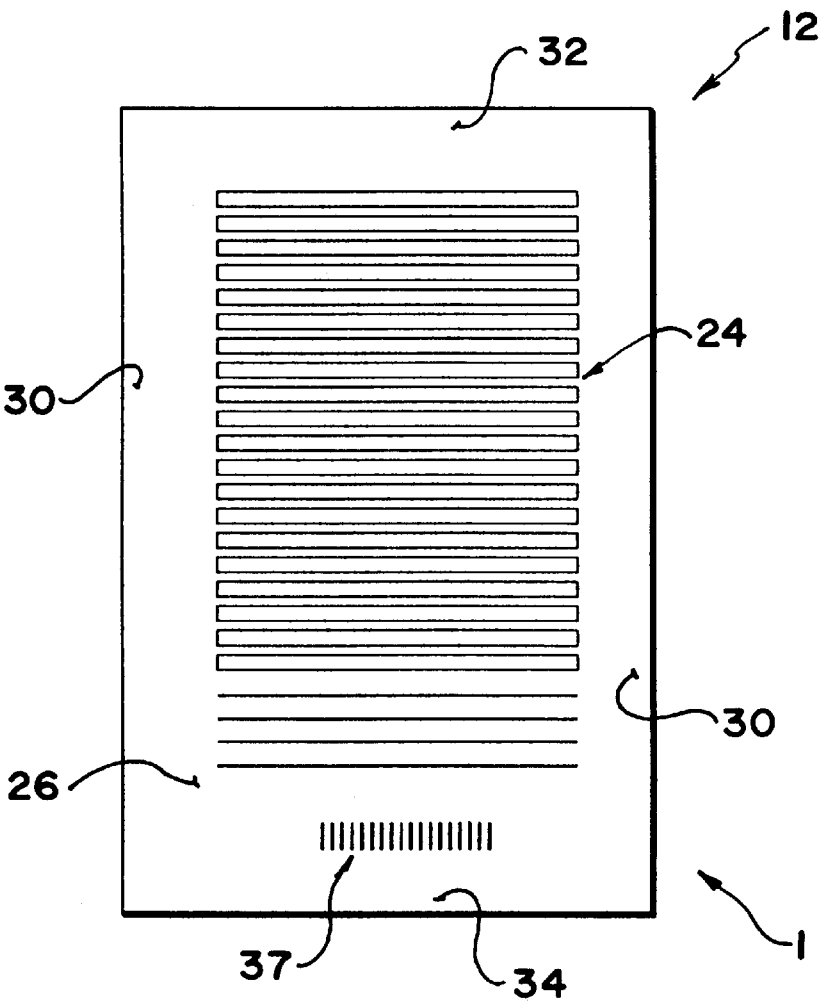
FIG. 2 is a rear view of the lottery ticket assembly.
Figure 4:
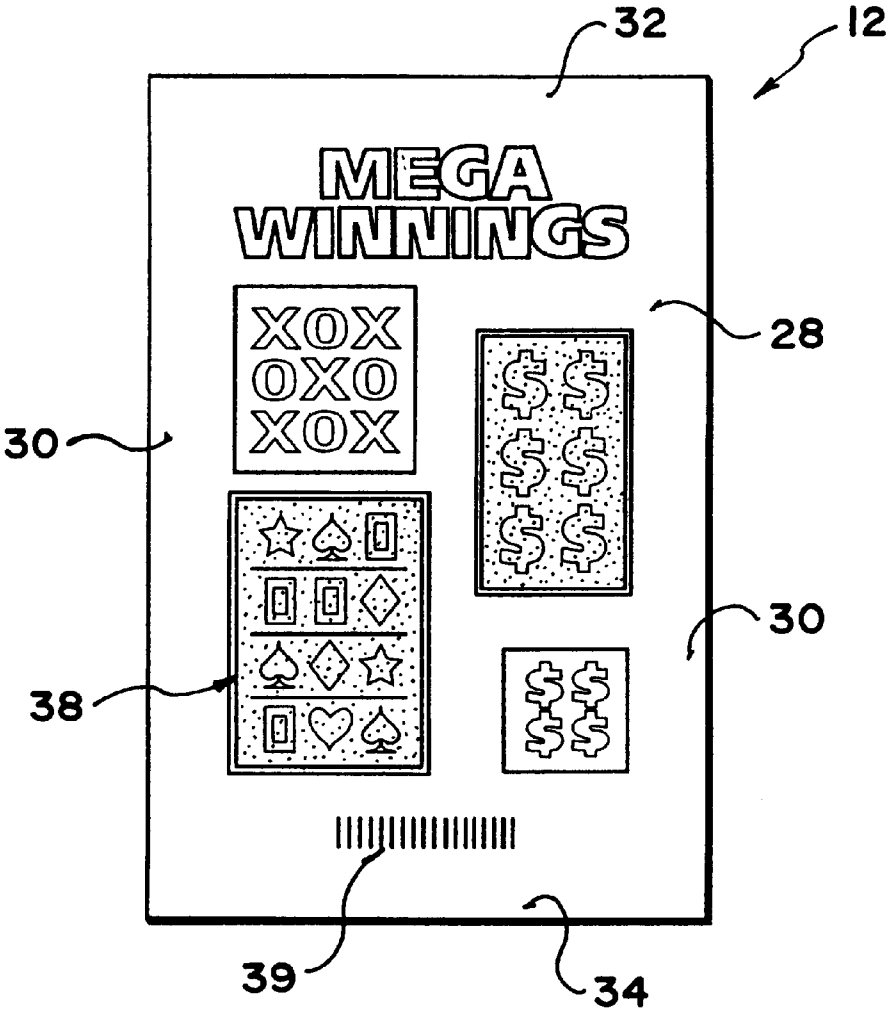
FIG. 4 is a rear view of the second ticket portion after the first portion is removed.

The second ticket portion 12 is formed by substantially flat substrate sheet material and has a front surface 26, a rear surface 28, side edges 30, a top edge 32 and a bottom edge 34 as shown in FIGS. 2 and 4. In some embodiments, the front surface 26 has promotional graphics or lottery information 24 printed thereon as shown in FIG. 2. The front surface 26 may also include a bar code 37 for identification of the lottery ticket 1. The rear surface 28 has lottery indicia 38 printed thereon and at least some of the lottery indicia 38 are covered with a scratch-off layer, as shown in FIG. 4 and as described above. The lottery indicia 38 may include a bar code 39 for identification and redemption and a void if removed section for security. It is of note that in some embodiments the bar code 27 on the first ticket portion 10 may differ from the bar code 39 on the second lottery ticket portion 12.

Figure 5:
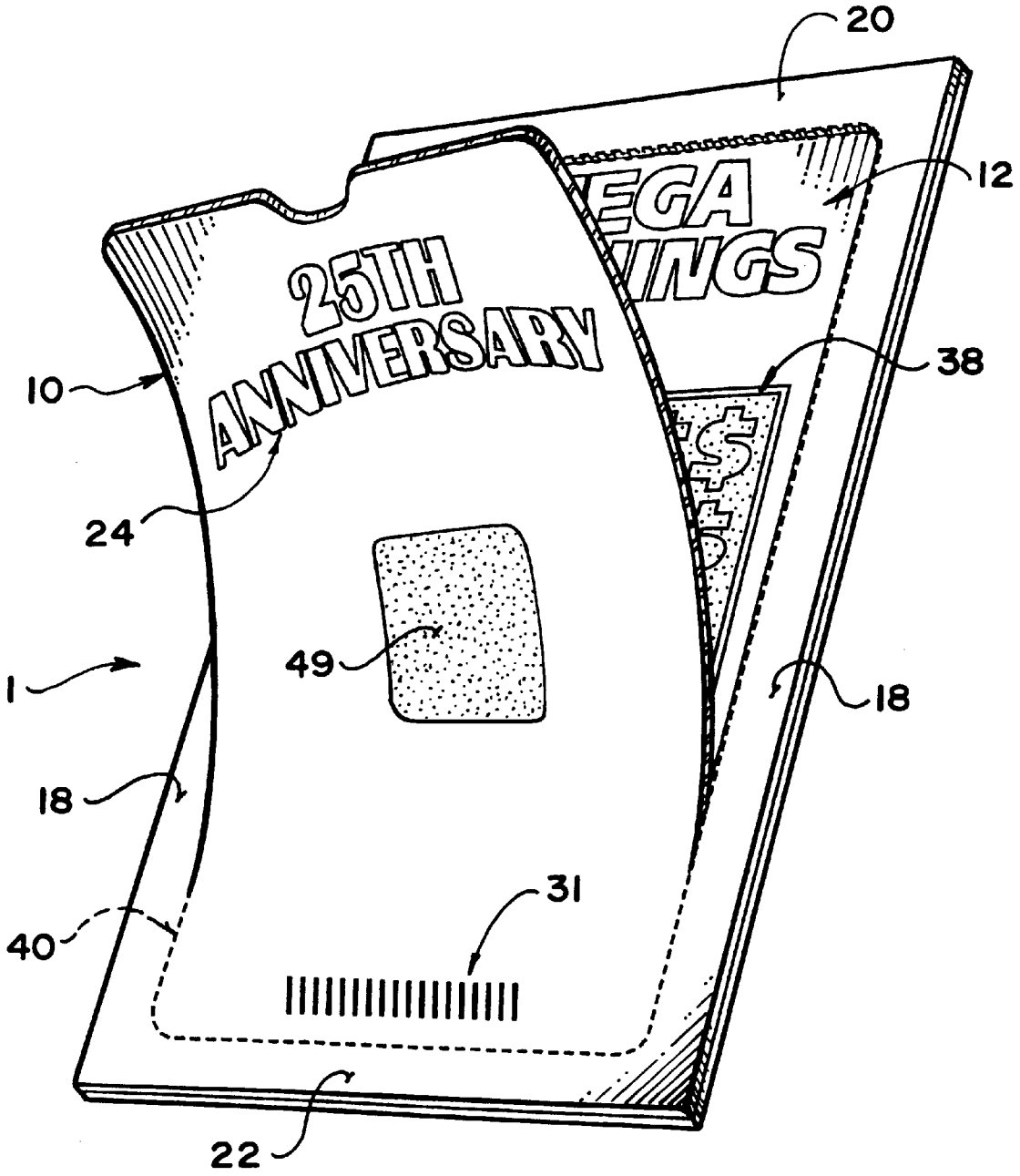
FIG. 5 is an elevational view of the lottery ticket of FIG. 1 being opened, the ticket being modified by the addition of a bonus game on the front surface of the first sheet.

The assembled lottery ticket 1 is shown in FIGS. 1 and 5 and thus forms in effect a pouch in that the outside surfaces of the tickets define surfaces available for graphics and the lottery games are concealed inside the pouch on the inwardly facing surfaces. This provides to some extent the improved security of the conventional pouch but avoids the use of a separate pouch material which is wasteful and costly. In the ticket of FIG. 1, the exposed surfaces of the ticket assembly are free from lottery game elements. In FIG. 5, however, an additional or bonus game is added on the front of the first ticket portion as indicated at 49.

The first ticket portion forms a part of a larger sheet including an outer surrounding band which overlaps a band portion of a sheet forming the second ticket portion. Specifically, the lottery ticket assembly 1 is formed by connecting the rear surface 16 of the sheet forming the first ticket portion 10 to the rear surface 28 of the sheet forming the second ticket portion 12 by an adhesive along the side edges 18, 30. As a result of this arrangement, the promotional graphics 24 and lottery information 38 printed on the front surface 14 of the first ticket portion 10 and the front surface 26 of the second ticket portion 12 are visible to the consumer but the lottery indicia 25 on the rear surface 16 of the first ticket portion 10 and the lottery indicia 38 on the rear surface 28 of the second ticket portion 12 are not visible or accessible.

Furthermore, the lottery ticket 1 is arranged to separate into at least two portions for exposing the lottery indicia 25 on the rear surface 16 of the first ticket portion 10 and the lottery indicia 38 on the rear surface 28 of the second ticket portion 12. In some embodiments, the front surface 14 of the first ticket portion 10 includes a line of weakness 40 inside the side edges 18 of the first ticket portion 10 and just inside the line of adhesive so that the central portion of the first ticket portion 10 can be separated from the second ticket portion 12, as shown in FIGS. 1 and 5. In some embodiments, the line of weakness 40 is introduced onto the front surface 14 of the first ticket portion 10 by die-cutting. The line of weakness 40 as shown includes a pull tab 42 for facilitating separation, as described below.

In use, the user purchases a lottery ticket 1. It is of note that as discussed above, the lottery ticket 1 is arranged such that the promotional graphics 24 and lottery information 38 printed on the front surface 14 of the first ticket portion 10 and the front surface 26 of the second ticket portion 12 are visible to the consumer but the lottery indicia 25 on the rear surface 16 of the first ticket portion 10 and the lottery indicia 38 on the rear surface 28 of the second ticket portion 12 are not visible or accessible. As a result of this arrangement, the lottery ticket 1 is secure and tamper-proof. Following purchase, the user separates a portion of the first ticket portion 10 from a portion of the second ticket portion 12 along the line of weakness 40 by grasping the pull tab 42 and pulling the lottery ticket 1 apart into two pieces as shown in FIG. 5. It is of note that the line of weakness 40 is introduced within the side edges 18 and within the line of adhesive so that the adhesive does not interfere with separation. This in turn exposes the lottery indicia 25 on the rear surface 16 of the first ticket portion 10 and the lottery indicia 38 on the rear surface 28 of the second ticket portion 12. The user can now "play" the game by removing the scratch-off layer. Furthermore, as discussed above, the bar code 27 for the first ticket portion 10 may differ from the bar code 39 of the second ticket portion 12 so that one portion of the lottery ticket 1 can be redeemed independently of the other.

Thus, the above-described lottery ticket 1 has an attractive outer surface due to the promotional graphics and lottery information printed on the front surfaces without the cost of additional packaging. Furthermore, the lottery indicia cannot be accessed without opening the lottery ticket 1.

Figure 6:
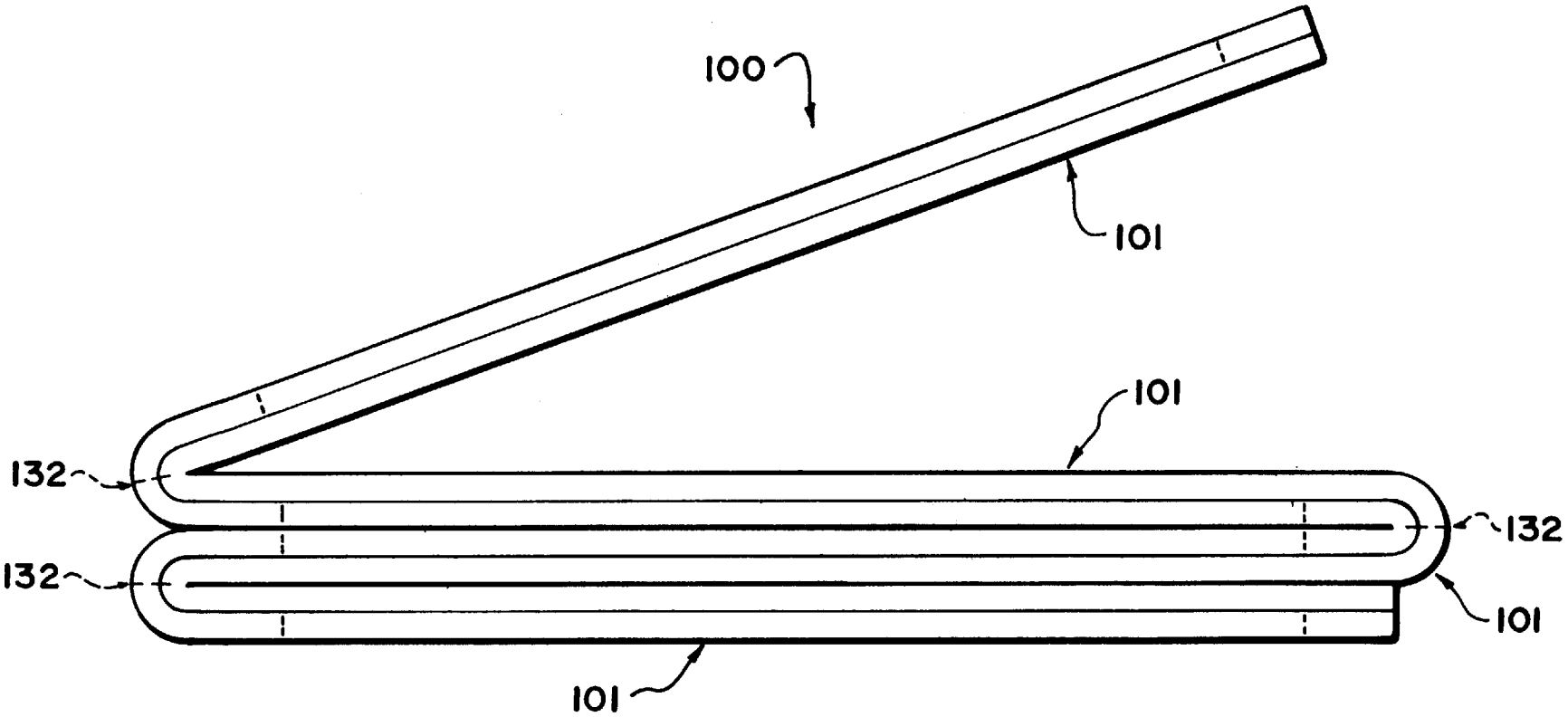
FIG. 6 is a side view of the lottery ticket assembly including a continuous connected strip of the tickets.
Figure 7:
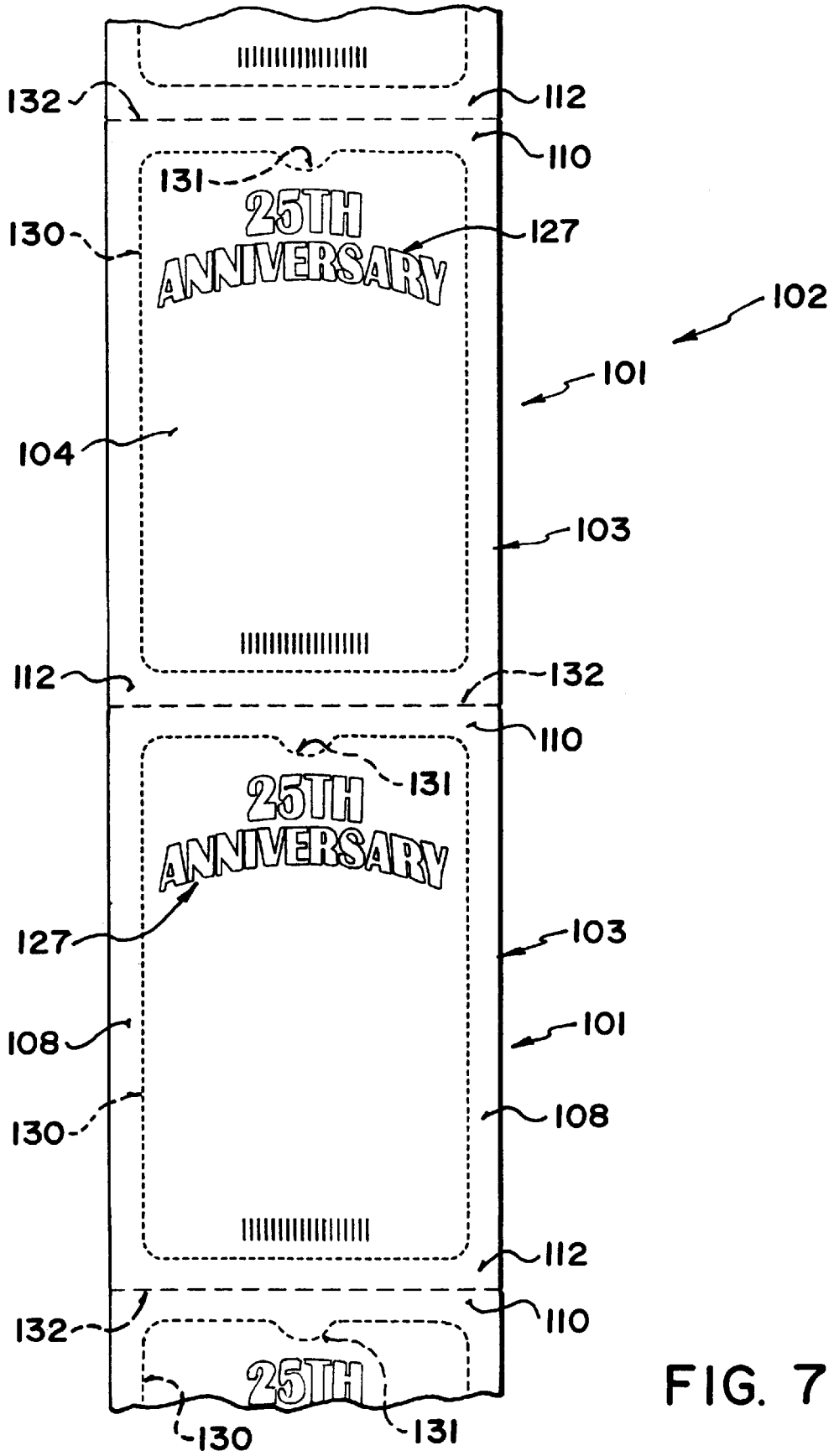
FIG. 7 is a front view of the lottery ticket assembly of FIG. 6 including a continuous connected strip of the tickets.
Figure 8:
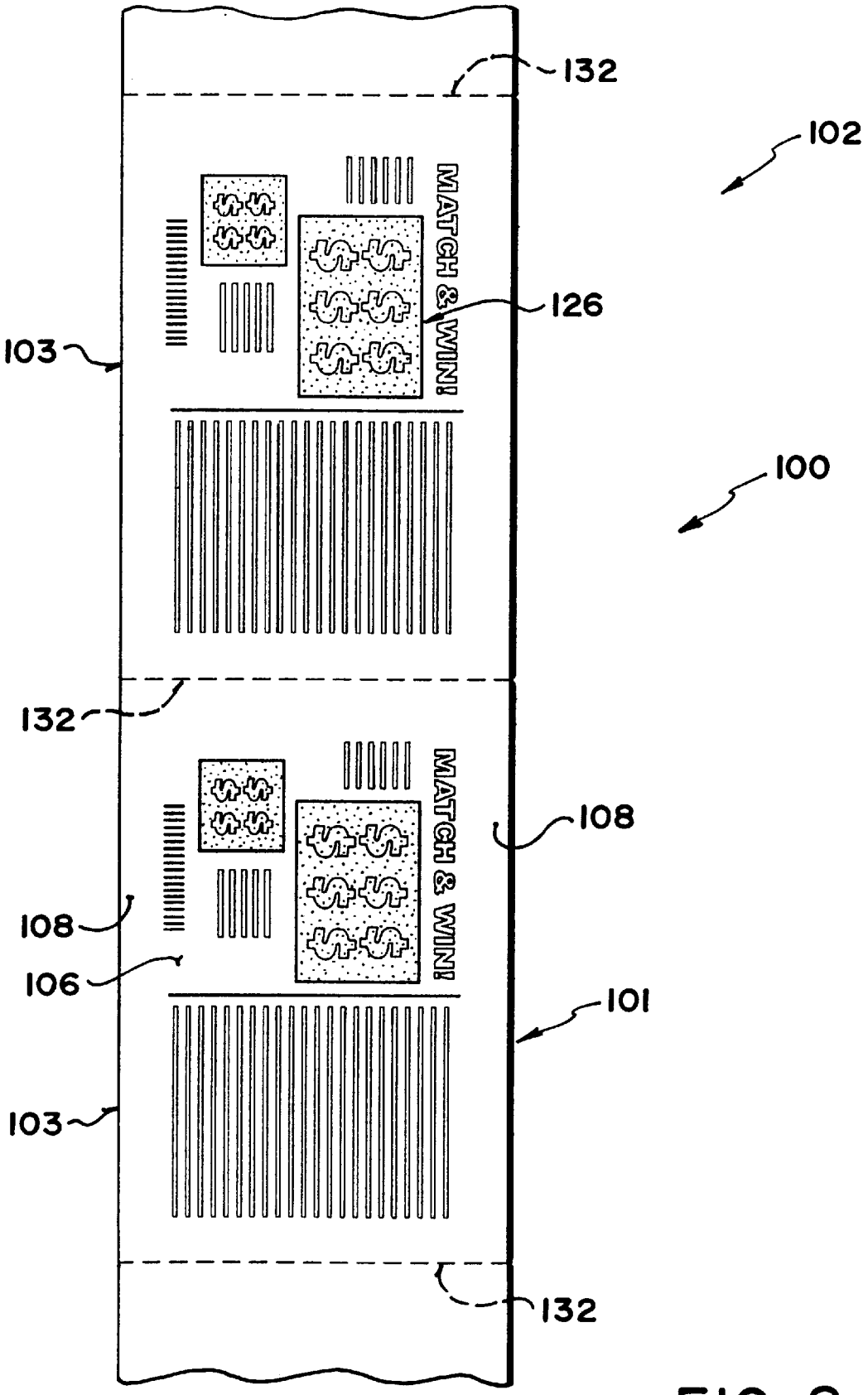
FIG. 8 is a front view of the first strip prior to assembly with the second strip.
Figure 9:
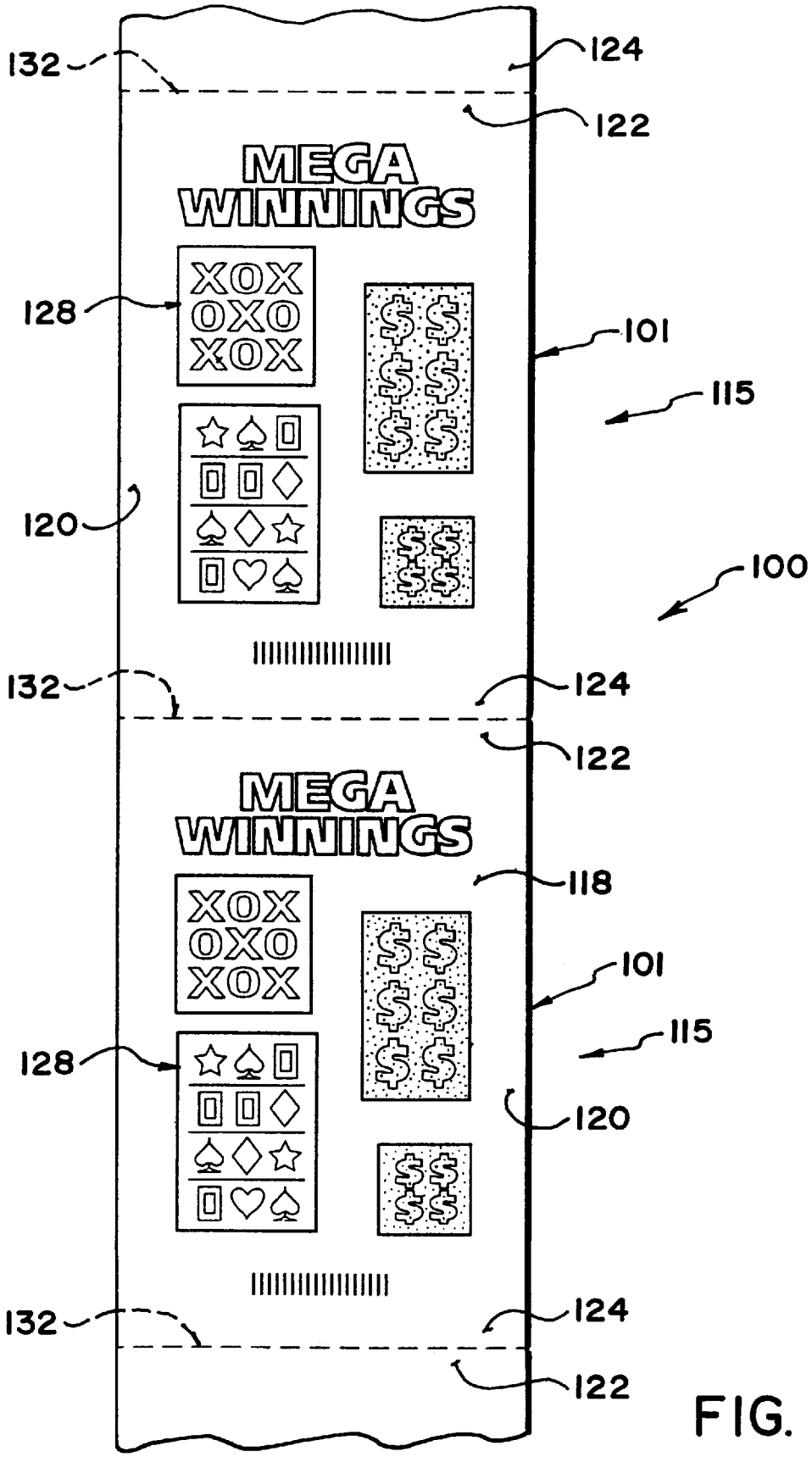
FIG. 9 is a rear view of the second strip prior to assembly, rear to rear, with the first strip.
Figure 10:
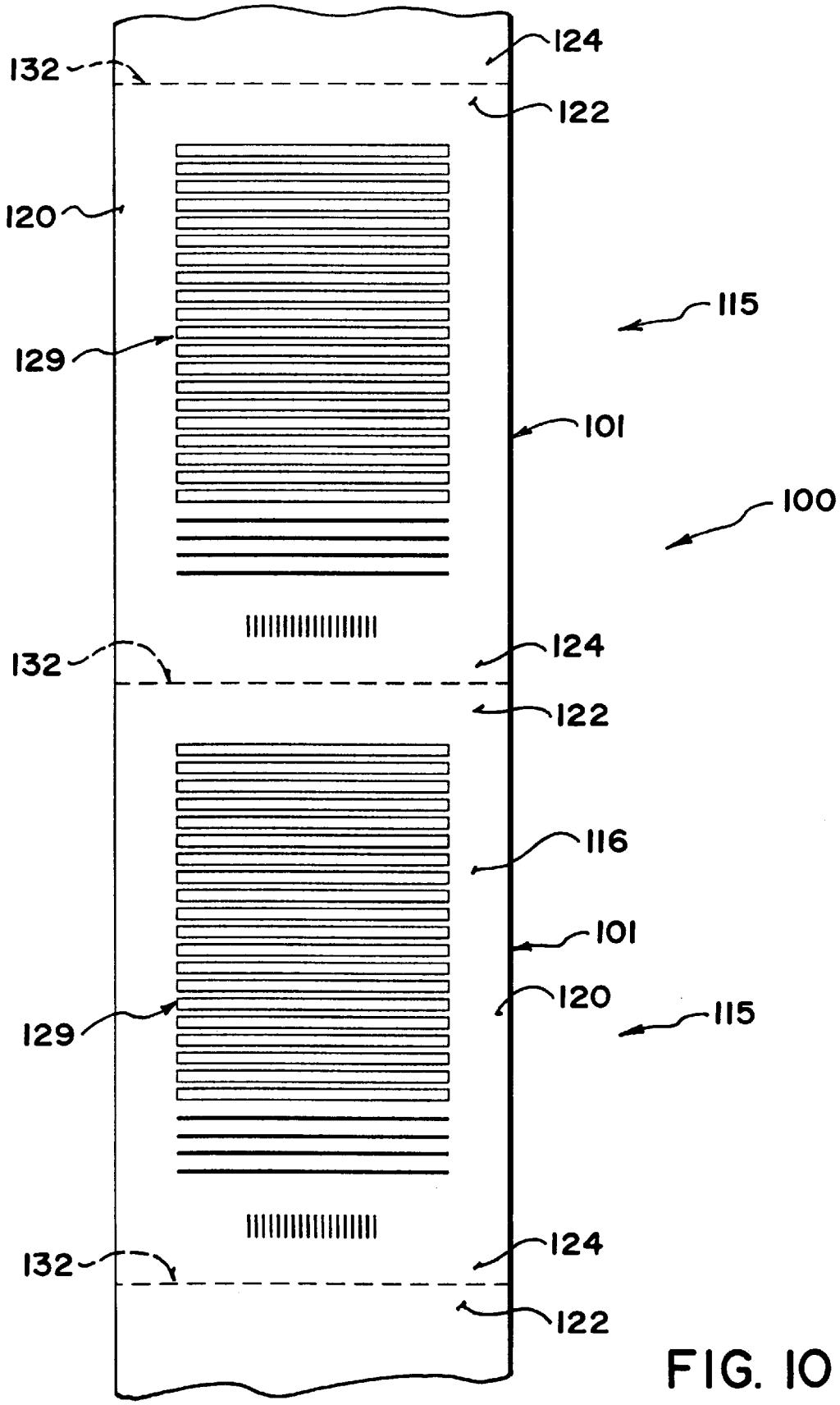
FIG. 10 is a front view of the second strip.

As shown in FIGS. 6 to 11 a method of preparing a lottery ticket construction 100 comprised of a plurality of lottery tickets 101 in a row. A first strip 102 is provided which is composed of a plurality of first ticket portions 103 each composed of a substantially flat sheet material and having a front surface 104, a rear surface 106, side edges 108, as shown in FIGS. 7 and 8. The ticket portions are not at this stage defined by separations, lines of weakness (perforations) or dividing lines but the intended top and bottom edges are shown at 110, 112. A second strip 114 is provided which is composed of a plurality of second ticket portions 115 each composed of a substantially flat sheet material and having a front surface 116, a rear surface 118, side edges 120, a top 122 and a bottom 124 as shown in FIGS. 9 and 10.

A plurality of lottery indicia 126 are variable image printed onto the strips at regular intervals on the rear surface 106 of the first strip 102 as shown in FIG. 8 and promotional graphics and/or lottery information 127 are printed on the front surface 104 of the first strip 102 as shown in FIG. 7.

Specifically, the plurality of lottery indicia 126 and the lottery information 127 are printed onto the first strip 102 such that a representative one of the plurality of lottery indicia 126 and the lottery information 127 is between the top 110 and the bottom 112 of a representative one of the plurality of first ticket portions 103. Similarly, a plurality of lottery indicia 128 are variable image printed at regular intervals on the rear surface 118 of the second strip 114 as shown in FIG. 9 and promotional graphics and/or lottery information 129 are printed on the front surface 116 of the second strip 114 as shown in FIG. 10. Specifically, the plurality of lottery indicia 128 and the lottery information 129 are printed onto the second strip 114 such that a representative one of the plurality of lottery indicia 128 and the lottery information 129 is between the top 122 and the bottom 124 of a representative one of the plurality of second ticket portions 115. It is of note that the lottery indicia 126, 128 may include bar codes for identification and redemption as well as void if removed areas for security. The bar codes may differ so that portions of a representative one of the plurality of lottery tickets 101 can be redeemed separated, as described below. Furthermore, at least some of the lottery indicia 126 on the rear surface 106 of the first strip 102 and the lottery indicia 128 on the rear surface 118 of the second strip 114 are covered with a scratch-off layer that obscures the lottery indicia and is removed by the user during play, as described above. Next, the rear surface 106 of the first strip 102 is placed in contact with the rear surface 118 of the second strip 114 and the first strip 102 and the second strip 114 are positioned relative to one another such that a representative one of the plurality of lottery indicia 126 on the rear surface 106 of the first strip 102 is aligned with and positioned opposite to a representative one of the plurality of lottery indicia 128 on the rear surface 118 of the second strip 114. In some embodiments, the proper alignment of the first strip 102 to the second strip 114 may be confirmed manually. The second strip 114 is separated from the first strip 102 such that alignment is maintained and an adhesive is applied to the rear surfaces 106, 118 along the side edges 108, 120 respectively. The rear surface 106 of the first strip 102 is then brought into contact with the rear surface 118 of the second strip 114 so that the first strip 102 is connected to the second strip 114. A plurality of lines of weakness 130 are then introduced into the front surface 104 of the first strip 102 at regular intervals such that a respective one of the plurality of lines of weakness 130 extends around the lottery indicia 126 on the rear surface 106 of a representative one of the first ticket portions 103. The lines of weakness 130 may be introduced for example by die-cutting. Furthermore, the line of weakness 130 includes a tear strip 131 for facilitating separation, as described below. It is of note that the line of weakness 130 is introduced within the edges 108 of a representative one of the plurality of first ticket portions 103 so that a representative one of the plurality of lottery tickets 101 can be separated into two portions as described below.

A plurality of rows of perforations 132 are then introduced into the lottery ticket construction 100 at junctions between the top edge of a representative one of the plurality of lottery tickets 101 and the bottom edge of an adjacent one of the plurality of lottery tickets 101. As a result of this arrangement, the plurality of lottery tickets 101 can be separated into individual lottery tickets by tearing along the rows of perforations 132. The plurality of lottery tickets 101 are folded along each of the plurality of rows of perforations 132 with the fold at the front edge of each lottery ticket being in a direction opposite to the fold at the rear edge of each lottery ticket so that the lottery tickets lie each on top of and parallel to the next, as shown in FIG. 6.

Figure 11:
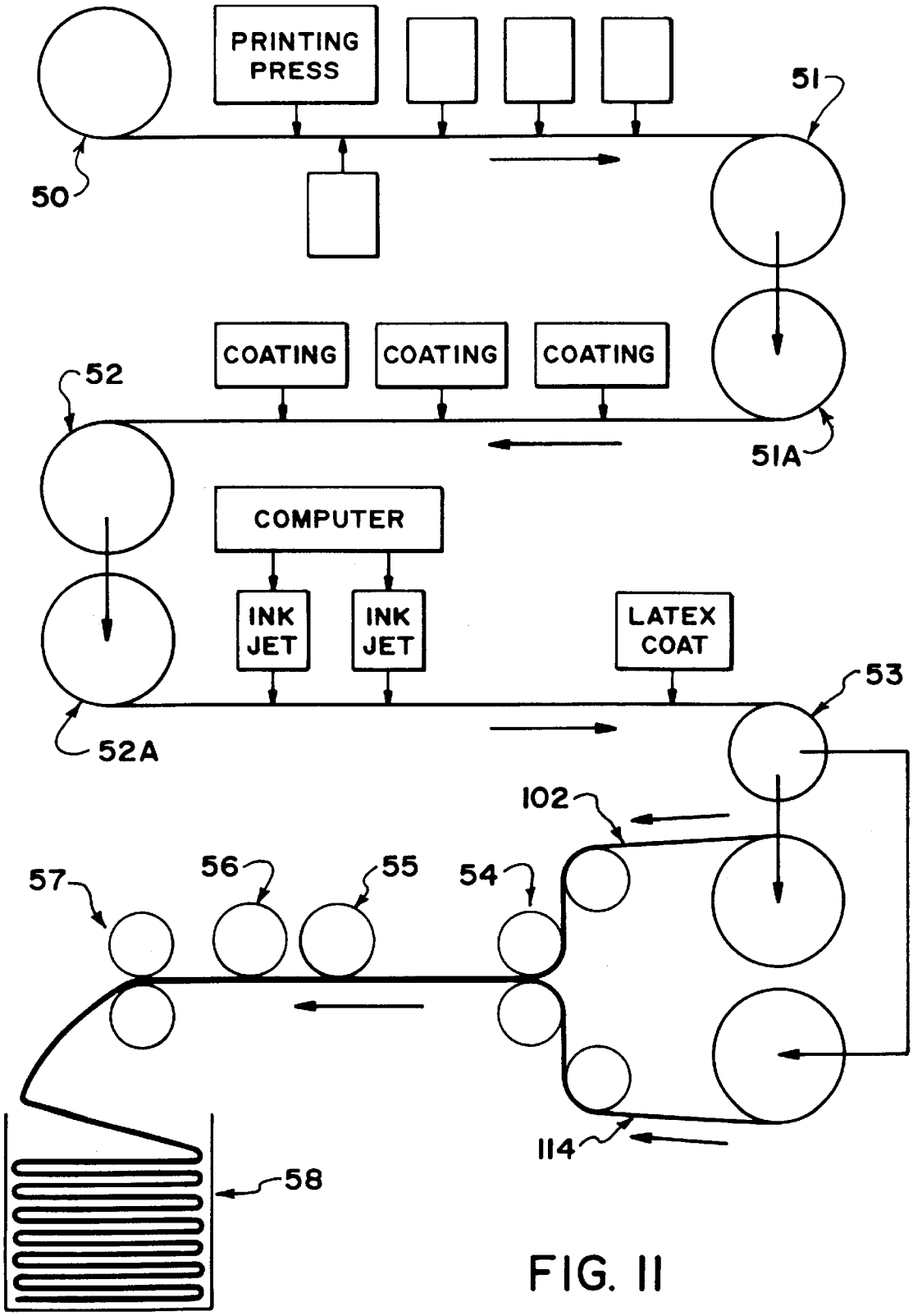
FIG. 11 is a schematic side elevational view of a process for forming the ticket assembly of FIG. 6.

In FIG. 11 is shown schematically the process described above. The process is shown in a number of discreet steps but it will be appreciated that the process can be integrated into a single continuous production line without the necessity for unrolling and re-rolling the strip in the separate steps as shown.

Thus in a first step of the process, an initial strip of blank paper stock is unrolled from a supply roll 50 and is rewound onto a rewind roll 51. As the strip is forwarded, graphics and base printing is applied onto the strip from a series of colour printing presses so as to provide preferably a full colour printing of both sides of the strip.

In the second step, the re-rolled roll is used as a supply as indicated at 51A and the strip passes through a coating station including a plurality of coating elements before being rewound at a rewind station 52. The coating elements provide a series of layers or lily pads over sections of the strip at which the lottery games are to be applied. This provides a security layer or coating for the strip which enhances security to prevent chemical, light or other attack onto the base paper stock to avoid improper examination of the tickets revealing the winning ticket without the necessity for scratching the scratch off layers. Various arrangements of security coating are known in the industry and thus this aspect is well known to one skilled in the art and further detail will not be described in detail herein.

The resultant or final layer of the security coating is generally a white lily pad so that the white layer does not interfere with or detract from the brightness of subsequent application of coloured printed materials or layers.

The re-rolled roll 52 is applied at a supply station 52A for a third step in the process where the strip is unrolled and re-rolled at a station 53. In the third step, the lottery indicia are applied to the white lily pad over the security layers previously described to provide the game data. The lottery indicia are applied by variable image printing techniques as opposed to use of fixed printing presses.

It will be appreciated that a printing press can apply only predetermined arrangements of characters which are set up in the printing press and cannot be readily or quickly varied. The variable image printing process to the contrary uses a computer controlled system to control conventional printing elements such as ink jet, bubble jet or laser so that the image applied can be varied to any particular requirement allowing each ticket to be entirely different from others. This technique can generate one color images, but more preferably two colors such as red and black or more color images.

The use of variable image printing techniques allows also the following advantages:

It avoids the use of a limited number of combinations of symbols in the game data which is otherwise available by conventional printing press.

The prize parameters, that is the arrangement and numbers of winning tickets relative to losing tickets, can be tailored to suit particular circumstances, customers or games and is not limited to the fixed arrangements available with the conventional printing press.

As the strip is continuous and is not cut from a press printed sheet, there are no markings or patterning of the substrate caused by mechanically cutting substrate pieces from a larger printed sheet, thus avoiding the possibility that the markings or patterning could be used to locate and identify winning tickets.

The application of a bar code (including machine and/or human readable portions) which is unique to the ticket and is applied directly with and at the same time as the game indicia to allow identification and validation of individual tickets.

Subsequent to the application of the game data a coating device applies the latex scratch-off coating in one or more layers using conventional techniques and materials. The coated strip is then wound at a winding station 53. Although it is shown for convenience that the latex coating is in line with the imaging, this is generally not so and the two steps are carried out independently on different lines.

Strips thus formed with the graphics printing, security coatings, game data and scratch-off layers are thus formed and available at the station 53. Two of these strips, printed with different data are then used in a lamination process at laminating and calendaring rolls 54. The laminated strips are then passed through a die cut roller system 55 and a kiss cut roller system 56 to apply the lines of weakness and perforations as previously described. The strip is then folded back and forth in a fan folding arrangement 57 to form a fan folded stack 58 of the finished tickets in the ticket assembly. The laminated tickets in the fan folded stack are also shown on larger scale in FIG. 6.

In use, the user purchases a lottery ticket and a representative one of the plurality of lottery tickets 101 is removed from the lottery ticket construction 100 from a dispensing system in which the fan folded stack is stored by tearing along the row of perforations 132. It is of note the representative one of the plurality of lottery tickets 101 is now functionally identical to lottery ticket 1 described above and can be used in a similar manner as described above. The above referenced PCT Application provides further detail of the fan folded construction and the dispensing thereof. The plurality of lottery tickets 101 are fan folded and if desired the folds can be arranged along each of the plurality of rows of perforations 132 with the fold at the front edge of each lottery ticket being in a direction opposite to the fold at the rear edge of each lottery ticket so that the lottery tickets lie each on top of and parallel to the next. Alternatively, the folds can be spaced along a number of tickets so that for each strip between two folds contains more than one ticket for example five such tickets.

While the preferred embodiments of the invention have been described above, it will be recognized and understood that various modifications may be made therein, and the appended claims are intended to cover all such modifications which may fall within the spirit and scope of the invention.

What is claimed is:

1. A lottery ticket assembly comprising:

a first ticket portion formed by substantially flat substrate sheet material having a front surface and a rear surface, said front surface having promotional graphics printed thereon, said rear surface having first lottery game indicia printed thereon by variable image printing and defining a first game to be played by a player, at least some of the first lottery game indicia being covered with a scratch-off layer arranged to be removable by the player to expose the first lottery game indicia in playing the first game; and a second ticket portion formed by substantially flat substrate sheet material having a front surface and a rear surface, said rear surface having second lottery game indicia printed thereon by variable image printing and defining a second game to be played by a player, at least some of the second lottery game indicia being covered with a scratch-off layer arranged to be removable by the player to expose the second lottery game indicia in playing the second game;

the rear surface of the sheet forming the first ticket portion being connected to the rear surface of the sheet forming the second ticket portion to form the lottery ticket assembly;

wherein the lottery ticket assembly is arranged to be separable by the player into said first and second ticket portions for exposing the first lottery game indicia covered by the scratch-off layer for playing of the first game by the player on the rear surface of the first ticket portion and the second lottery game indicia covered by the scratch-off layer for playing of the second game by the player on the rear surface of the second ticket portion.

2. The lottery ticket assembly according to claim 1 wherein the sheet forming the first ticket portion includes a line of weakness for separating the lottery ticket assembly into said first and second ticket portions.

3. The lottery ticket assembly according to claim 2 wherein the first ticket portion and the second ticket portion have side edges and are connected along all of said side edges to fully encompass the rear surfaces thereof.

4. The lottery ticket assembly according to claim 3 wherein the sheet forming the first ticket portion and the sheet forming the second ticket portion are connected by a strip of an adhesive.

5. The lottery ticket assembly according to claim 4 wherein the sheet forming the first ticket portion includes a line of weakness for separating the lottery ticket assembly into said first and second ticket portions and wherein the line of weakness is located within the side edges of the first ticket portion such that the strip of adhesive does not interfere with separation of the lottery ticket assembly into said first and second ticket portions.

6. The lottery ticket assembly according to claim 1 wherein the front surface of both of the first and second ticket portions is free from lottery ticket came indicia covered by a scratch-off layer arranged to be removed by the player for playing of a game by the player.

7. The lottery ticket assembly according to claim 1 wherein the sheet forming the first ticket portion and the sheet forming the second ticket portion are coextensive.

8. The lottery ticket assembly according to claim 1 wherein the lottery game indicia on the front surface of the first ticket portion includes a first bar code and the lottery game indicia on the front surface of the second ticket portion includes a second bar code, said first bar code differing from said second bar code for redeeming the first ticket portion and the second ticket portion independently of one another.

9. The lottery ticket assembly according to claim 2 including a pull tab for initiating separation of the first ticket portion from the second ticket portion, said pull tab being at a position on the rear surface portion of the first ticket portion within the line of weakness.

10. The lottery ticket assembly according to claim 1 wherein the front surface of one of the first and second ticket portions includes bonus lottery game indicia printed thereon by variable image printing and defining a bonus game to be played by the player, at least some of the bonus lottery game indicia being covered with a scratch-off layer arranged to be removable by the player to expose the bonus lottery game indicia in playing the bonus game.

11. A method of preparing a lottery ticket assembly comprising:

providing a first continuous substrate sheet material in a first strip having a front surface and a rear surface;

providing a second continuous substrate sheet material in a second strip having a front surface and a rear surface;

printing promotional graphics onto said front surface of each of the first and second strips;

printing first lottery game indicia onto said rear surface of said first strip by variable image printing and defining a row of first games to be played by a player;

covering at least some of said first lottery game indicia with a scratch-off layer arranged to be removable by the player to expose the first lottery game indicia in playing the first game;

printing second lottery game indicia onto said rear surface of said second strip by variable image printing and defining a row of second games to be played by the player;

covering at least some of said second lottery game indicia with a scratch-off layer arranged to be removable by the player to expose the second lottery game indicia in playing the second game;

connecting the rear surface of the first strip to the rear surface of the second strip to form a row of connected tickets each including one of said first games and one of said second games;

providing between each ticket and the next a first line of weakness for separation of each ticket from the next;

and providing a second line of weakness on the first strip of each ticket for separation of each ticket by the player into a first ticket portion formed by the first strip and including the first lottery game indicia and the scratch-off layer thereon which is thus exposed for playing by the player and a second ticket portion formed by the second strip and including the second lottery game indicia and the scratch-off layer thereon which is thus exposed for playing by the player.

12. The method according to claim 11 wherein the first strip and the second strip have side edges and the step of connecting the first and second strips includes connecting the first and second strips along said side edges.

13. The method according to claim 12 wherein the step of connecting the first and second strips includes using a strip of an adhesive.

14. The method according to claim 13 wherein the second line of weakness is located inside of the strip of adhesive.

15. The method according to claim 14 wherein the step of printing the first lottery game indicia on the first strip includes printing for each first game of the row a respective first bar code and wherein the step of printing the second lottery game indicia on the second strip includes printing for each second game of the row a respective second bar code, and arranging said first bar code for each ticket to differ from said second bar code of the respective ticket so that the first ticket portion and the second ticket portion can be redeemed independently.

16. A lottery ticket construction comprising:

a plurality of lottery ticket assemblies each comprising:

a first ticket portion formed by substantially flat substrate sheet material having a front surface and a rear surface, said front surface having promotional graphics printed thereon, said rear surface having first lottery game indicia printed thereon by variable image printing and defining a first game to be played by a player, at least some of the first lottery game indicia being covered with a scratch-off layer arranged to be removable by the player to expose the first lottery game indicia in playing the first game; and a second ticket portion formed by substantially flat substrate sheet material having a front surface and a rear surface, said rear surface having second lottery game indicia printed thereon by variable image printing and defining a second game to be played by a player, at least some of the second lottery game indicia being covered with a scratch-off layer arranged to be removable by the player to expose the second lottery game indicia in playing the second game;

the rear surface of the sheet forming the first ticket portion being connected to the rear surface of the sheet forming the second ticket portion to form the lottery ticket assembly;

wherein the lottery ticket assembly is arranged to be separable by the player into said first and second ticket portions for exposing the first lottery game indicia covered by the scratch-off layer for playing of the first game by the player on the rear surface of the first ticket portion and the second lottery game indicia covered by the scratch-off layer for playing of the second game by the player on the rear surface of the second ticket portion;

wherein the lottery ticket assemblies are connected each to the next to form a continuous row of the ticket assemblies;

and wherein the lottery ticket assemblies each have a transverse row of perforations dividing each from the next for separation by tearing of the tickets for dispensing.

17. The lottery ticket construction according to claim 16 wherein the lottery ticket assemblies are fan folded with a fold at a front edge of a lottery ticket assembly being in a direction opposite to a fold at a rear edge of a lottery ticket assembly so that the lottery tickets assemblies lie on top of and parallel to one another for dispensing.

18. The lottery ticket construction according to claim 16 wherein on each lottery ticket assembly the sheet forming the first ticket portion includes a line of weakness for separating the lottery ticket assembly into said first and second ticket portions.

19. The lottery ticket construction according to claim 16 wherein the sheet forming the first ticket portion and the sheet forming the second ticket portion of each lottery ticket assembly have side edges and are connected along all of said side edges to fully encompass the rear surfaces thereof.

20. The lottery ticket construction according to claim 16 wherein the front surface of both of the first and second ticket portions of each lottery ticket assembly is free from lottery ticket game indicia covered by a scratch-off layer arranged to be removed by the player for playing of a game by the player.

21. The lottery ticket construction according to claim 16 wherein, for each lottery ticket assembly, the lottery game indicia on the front surface of the first ticket portion includes a first bar code and the lottery game indicia on the front surface of the second ticket portion includes a second bar code, said first bar code differing from said second bar code for redeeming the first ticket portion and the second ticket portion independently of one another.

* * * * *